US007694955B2

(12) United States Patent
Asada

(10) Patent No.: US 7,694,955 B2
(45) Date of Patent: Apr. 13, 2010

(54) SHEET-FEED DEVICE AND IMAGE RECORDING APPARATUS EQUIPPED WITH THE SAME

(75) Inventor: Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/127,003

(22) Filed: May 26, 2008

(65) Prior Publication Data

US 2008/0290585 A1 Nov. 27, 2008

(30) Foreign Application Priority Data

May 25, 2007 (JP) ..... 2007-139537

(51) Int. Cl.
*B65H 3/52* (2006.01)

(52) U.S. Cl. ..... 271/121

(58) Field of Classification Search ..... 271/121, 271/122, 124, 167, 104, 137
See application file for complete search history.

(56) References Cited

U.S. PATENT DOCUMENTS 6,536,757 B2 * 3/2003 Chang ..... 271/16
7,066,461 B2 6/2006 Asada
2004/0251602 A1 * 12/2004 Ruhe et al. ..... 271/167
2006/0180992 A1 8/2006 Asada
2007/0069447 A1 3/2007 Watanabe

FOREIGN PATENT DOCUMENTS

JP 2004-149297 A 5/2004
JP 2006-182481 A 7/2006
JP 2007-091429 A 4/2007

* cited by examiner

*Primary Examiner*—Patrick H Mackey
*Assistant Examiner*—Thomas A Morrison
(74) *Attorney, Agent, or Firm*—Baker Botts L.L.P.

(57) ABSTRACT

A sheet-feed device, including: a sheet accommodating portion for accommodating sheets; a sheet-feed roller which feeds one of the sheets located uppermost among the accommodated sheets; an inclined sheet-separation plate; separation pawls arranged on the sheet-separation plate for cooperating with the roller to separate the one of the sheets from the other sheets; a sheet guide member supported on the sheet-separation plate so as to pivot about an axis and including: a first contact portion located on a sheet feeding route and configured to contact the separated sheet; and a second contact portion located on one side of the axis remote from the first contact portion and configured to protrude from the sheet-separation plate so as to contact the separated sheet owing to a pivotal movement of the guide member by a contact of the separated sheet with the first contact portion, whereby the separated sheet is moved away from the separation pawls.

7 Claims, 10 Drawing Sheets

SHEET-FEED DEVICE AND IMAGE RECORDING APPARATUS EQUIPPED WITH THE SAME

CROSS REFERENCE TO RELATED APPLICATION

The present application claims priority from Japanese Patent Application No. 2007-139537, which was filed on May 25, 2007, the disclosure of which is herein incorporated by reference to its entirety.

BACKGROUND OF THE INVENTION

1. Field of the Invention

The present invention relates to a sheet-feed device configured such that recording sheets stacked on a sheet accommodating portion are separated one by one by a sheet-feed roller or rollers and a plurality of separation pawls, for feeding the separated one of the recording sheets. The invention also relates to the image recording apparatus having an image recording unit for recording an image on the separated one of the recording sheets fed by the sheet-feed device.

2. Discussion of Related Art

An image recording apparatus, such as a printer, a copying machine, a facsimile machine or the like, is generally equipped with a sheet-feed device that separates cut sheets (i.e., recording sheets each as a recording medium) one by one and feeds the separated sheet to an image recording unit of the image recording apparatus.

For instance, Patent Document 1 (U.S. Patent Application Publication No. US 2006/0180992 A1 corresponding to JP-A-2006-182481) discloses a sheet-feed device provided on an image recording apparatus. The disclosed sheet-feed device includes: a sheet-supply cassette, as a sheet accommodating portion, opening upward and accommodating a stack of recording sheets; and a sheet-feed roller provided at a distal end of an arm which is disposed above the sheet-supply cassette so as to be pivotable upward and downward. The sheet-supply cassette includes: an inclined sheet-separation plate disposed at its downstream end portion in a sheet-feed direction in which the recording sheets are fed; and a sheet-separation member disposed at a middle portion of the inclined sheet-separation plate in its width direction, i.e., in a width direction of the recording sheets.

The sheet-separation member disclosed in the Patent Document 1 includes: a metal base portion; pawl-like separation protrusions; arm portions each of which supports a corresponding one of the separation protrusions at opposite sides thereof; and leaf spring portions which are formed integrally with the base portion and by which the sheet-separation member is fixed to a prescribed position on a rear surface of the inclined sheet-separation plate. The separation protrusions, the arm portions, and the leaf spring portions are formed on the base portion by press working so as to be arranged in the sheet-feed direction at suitable intervals. Each of the separation protrusions is configured to protrude, by a suitable amount, in a direction in which the separation protrusion is to contact the recording sheet being fed in the sheet-feed direction. Each separation protrusion protrudes through a corresponding one of windows formed in the inclined sheet-separation plate so as to be arranged in the sheet-feed direction.

In the sheet-feed device disclosed in the Patent Document 1, the sheet-feed roller is rotatably driven while pressing an uppermost one of the recording sheets stacked in the sheet-supply cassette, whereby the recording sheets accommodated in the sheet-supply cassette are fed one by one. Since the sheet-feed roller is disposed so as to swing upward and downward, a pressing force with which the sheet-feed roller presses the recording sheets accommodated in the sheet-supply cassette varies depending on a vertical position of the sheet-feed roller, i.e., depending on the amount of the recording sheets stacked in the sheet-supply cassette. In the thus constructed sheet-feed device, where the pressing force of the sheet-feed roller with which the sheet-feed roller presses the recording sheets is large, there may be a risk of so-called multi-feeding, namely, a risk that two or more of the recording sheets are fed at one time in an overlapping state, from the stack of the recording sheets accommodated in the sheet-supply cassette.

In this respect, where two or more of the recording sheets are fed at one time in the sheet-feed device disclosed in the Patent Document 1, leading edges of the respective two or more of the recording sheets come into contact with the separation protrusions provided on the inclined sheet-separation plate, so that the two or more of the sheets being fed in the overlapping state are separated from one another, namely one by one, by a cooperative action of the sheet-feed roller and the separation protrusions. Thus, the above-indicated multi-feeding is prevented in the sheet-feed device disclosed in the Patent Document 1.

The thus separated one of the recording sheets by the cooperative action of the sheet-feed roller and the separation protrusions is fed to the image recording unit disposed above the sheet-supply cassette via a sheet-feed path having a U-turned portion that is provided above the inclined sheet-separation plate, so that an image is recorded on the one of the recording sheets by the image recording unit, and the sheet is consequently discharged through a sheet-discharge portion.

In the thus constructed sheet-feed device disclosed in the Patent Document 1, each of the recording sheets accommodated in the sheet-supply cassette reaches the image recording unit through the sheet-feed path, and the image recording unit records an image on the recording sheet from above the recording sheet. Accordingly, the recording surface of each of the recording sheets on which an image is to be recorded by the image recording unit faces downward in a state in which the recording sheets are accommodated in the sheet-supply cassette. During feeding of each of the recording sheets through the U-turned portion of the sheet-feed path, the recording sheet is turned upside down, so that the recording surface of the recording sheet faces upward.

Before the recording sheet passes through the U-turned portion of the sheet-feed path, the recording sheet is fed on the inclined sheet-separation plate while facing the separation protrusions that are provided on the inclined sheet-separation plate. As described above, since the direction of feeding of each recording sheet is changed during the recording sheet passes through the U-turned path portion whose radius of curvature is small, it is likely that the recording surface of the recording sheet being fed comes into strong contact with the separation protrusions. In this instance, the sheet recording surface may surfer from scratches or damages due to the strong contact with the separation protrusions, undesirably causing a problem that the quality of the image to be recorded on the damaged recording surface is deteriorated.

The above-described problem is serious particularly when a glossy paper which has a larger thickness and is more unlikely to bend, than a plain paper (such as a copy paper), is used. The glossy paper is used exclusively for recording photographic data with use of a large amount of ink and includes a base layer and a coating layer which is superposed on the base layer for adjusting absorption of ink, for instance. One of opposite surfaces of the glossy paper on which the coating layer is formed functions as the recording surface.

Where the glossy paper is used as the recording medium in the sheet-feed device constructed as described above, there may be a possibility that the coating layer on the recording surface comes into contact with the separation protrusions. As mentioned above, the glossy paper has a lager thickness and is more unlikely to bend, than the plain paper. Accordingly, the glossy paper tends to strongly contact the separation protrusions. In other words, where the glossy paper is used as the recording medium, the coating layer on the recording surface may be seriously damaged, resulting in a considerable difference in the image quality between the damaged portion of the recording surface and the other portion of the recording surface. Because the use of the glossy paper has the great advantage of providing or assuring excellent image quality, the deterioration in the image quality due to the damage of the coating layer by the contact with the separation protrusions is quite serious.

In this regard, the sheet-feed device disclosed in the above-indicated Patent Document 1 is configured such that the height, i.e., the amount of protrusion, of one of the separation protrusions located on the most downstream side in the sheet-feed direction is made smaller than that of the other separation protrusions located on the upstream side, thereby reducing the damage of the sheet recording surface.

SUMMARY OF THE INVENTION

In the sheet-feed device disclosed in the above-indicated Patent Document 1, however, because the separation protrusions are formed by punching and bending a metal plate, the tip of each separation protrusion may be angular or pointed. In this instance, the sheet recording surface may be scraped or rubbed by the tips of the separation protrusions, resulting in a damage of the sheet recording surface. In particular when the recording sheets accommodated in the sheet-supply cassette are the glossy papers that are hard to bend, each of the recording sheets tends to be pressed onto the inclined sheet-separation plate due to resistance of the recording sheet generated during feeding through the U-turned path portion having a small radius of curvature. Accordingly, it is impossible to completely prevent the damage of the sheet recording surface.

It is therefore a first object of the invention to provide a sheet-feed device capable of preventing a surface of a recording sheet to be fed, from being damaged. It is a second object of the invention to provide an image recording apparatus equipped with such a sheet-feed device.

The above-indicated first object of the invention may be attained according to a first aspect of the invention, which provides a sheet-feed device, comprising: a sheet accommodating portion in which recording sheets are accommodated so as to be stacked on each other; a sheet-feed roller which feeds one of the recording sheets accommodated in the sheet accommodating portion, which one of the recording sheets is located uppermost among the recording sheets accommodated in the sheet accommodating portion; an inclined sheet-separation plate which is disposed at a downstream portion of the sheet accommodating portion in a sheet-feed direction in which the one of the recording sheets is fed, so as to extend in a direction perpendicular to the sheet-feed direction and which is inclined, at a prescribed angle, with respect to the recording sheets accommodated in the sheet accommodating portion, the inclined sheet-separation plate having a height larger than a height of a maximum number of the recording sheets that can be accommodated in the sheet accommodating portion; a plurality of separation pawls which are arranged on the inclined sheet-separation plate so as to be suitably spaced apart from each other in the sheet-feed direction and which cooperate with the sheet-feed roller to separate the one of the recording sheets from other recording sheets; a sheet guide member which is supported on the inclined sheet-separation plate so as to pivot about a pivot axis that is perpendicular to the sheet-feed direction, the sheet guide member including: a first contact portion which is located on a sheet feeding route on which the one of the recording sheets is fed and which is configured to contact the separated one of the recording sheets; and a second contact portion which is located on one of opposite sides of the pivot axis that is remote from the first contact portion and which is configured to protrude from the inclined sheet-separation plate so as to contact the separated one of the recording sheets owing to a pivotal movement of the sheet guide member by a contact of the separated one of the recording sheets with the first contact portion, whereby the separated one of the recording sheets is moved away from the plurality of separation pawls.

In the sheet-feed device constructed as described above, an uppermost one of the recording sheets stacked in the sheet accommodating portion is fed by the sheet-feed roller. At the downstream portion of the sheet accommodating portion in the sheet-feed direction, the inclined sheet-separation plate is disposed which has the plurality of separation pawls formed thereon and which is inclined at the prescribed angle. The separation pawls protrude, by a prescribed protrusion amount, from the surface of the inclined sheet-separation plate and are arranged in the sheet-feed direction. Accordingly, even when there occurs so-called multi-feeding in which two or more of the recording sheets are fed at one time in an overlapping state, the overlapped sheets can be separated one by one by a cooperative action of the sheet-feed roller and the separation pawls.

In the sheet-feed device constructed as described above, the sheet guide member is pivotably supported on the inclined sheet-separation plate. The first contact portion of the sheet guide member is located on the sheet feeding route. Accordingly, when the one of the recording sheets separated by the cooperative action of the sheet-feed roller and the separation pawls is fed, the leading edge of that one sheet comes into contact with the first contact portion, so that the sheet guide member pivots about the pivot axis. Owing to the pivotal movement of the sheet guide member, the second contact portion of the sheet guide member comes into contact with the recording sheet, more specifically, its surface. As a result, the sheet is moved in a direction away from the separation pawls. That is, the sheet being fed is prevented from coming into contact with the separation pawls. Thus, it is possible to obviate a damage of the surface of the recording sheet by the separation pawls.

The above-indicated second object of the invention may be attained according to a second aspect of the invention, which provides an image recording apparatus, comprising: the sheet-feed device according to the above-indicated first aspect; an image recording unit which records an image on the one of the recording sheets fed by the sheet-feed device; and a sheet discharger which discharges the one of the recording sheets on which the image has been recorded by the image recording unit.

In the image recording apparatus constructed as described above, the image recording unit records an image on the separated sheet fed by the sheet-feed device, and the sheet on which the image has been recorded is discharged by the sheet discharger. According to the present image recording apparatus, the image can be recorded on the recording sheet which is free from the damage by the separation pawls, so that the quality of the image recorded on the sheet is not deteriorated.

BRIEF DESCRIPTION OF THE DRAWINGS

The above and other objects, features, advantages and technical and industrial significance of the invention will be better understood by reading a following detailed description of a preferred embodiment of the invention, when considered in connection with the accompanying drawings, in which.

DETAILED DESCRIPTION OF THE PREFERRED EMBODIMENT

Figure 1:
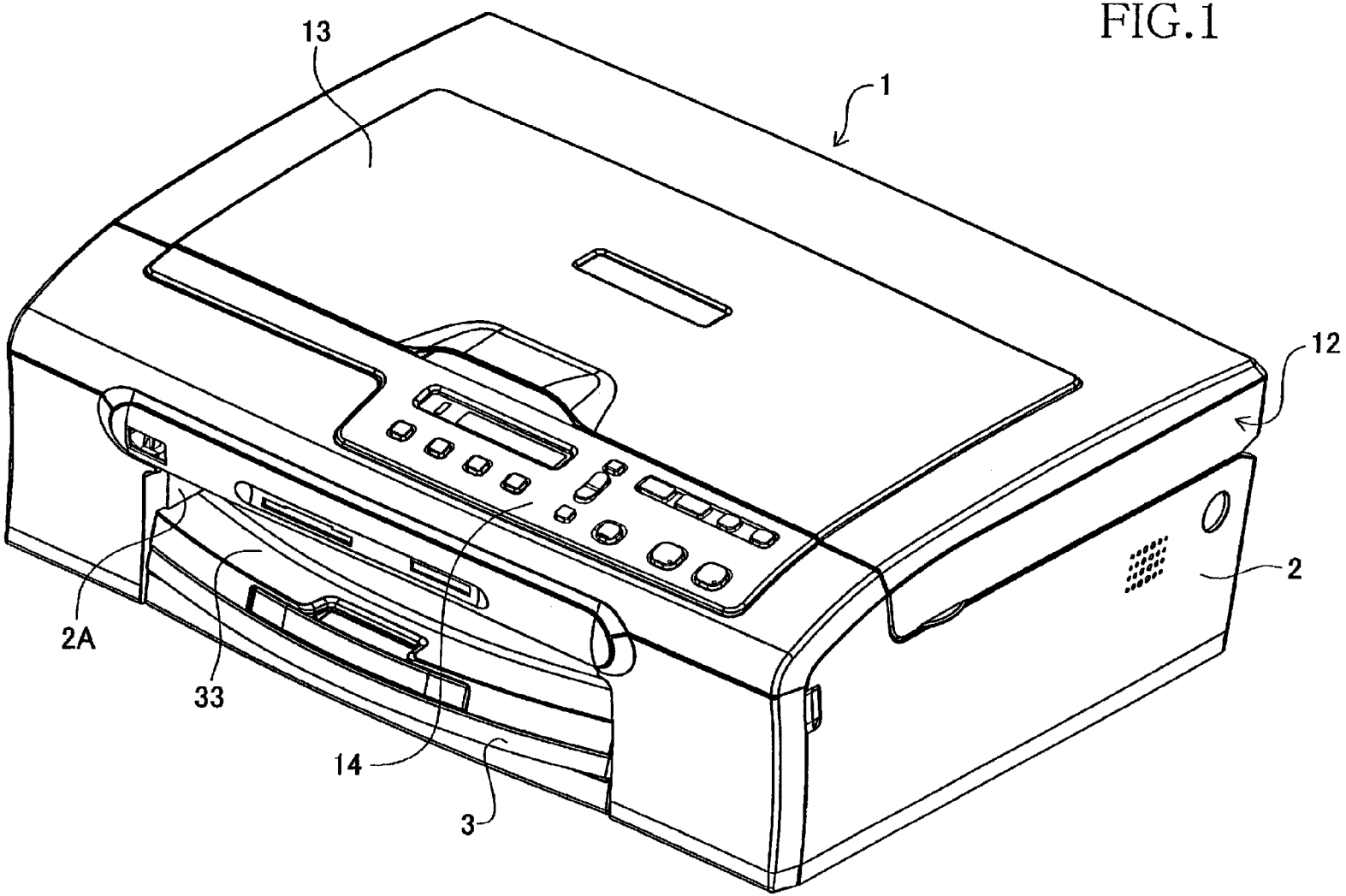
FIG. 1 is a perspective view showing an image recording apparatus according to one embodiment of the present invention.

Referring to the drawings, there will be explained in detail a sheet-feed device and an image recording apparatus equipped with the same, to which the present invention is applied. An image recording apparatus 1 according to one embodiment of the present invention is a multi-function device (MFD) having a printing function, a copying function, a scanning function, and a facsimile function.

Figure 2:
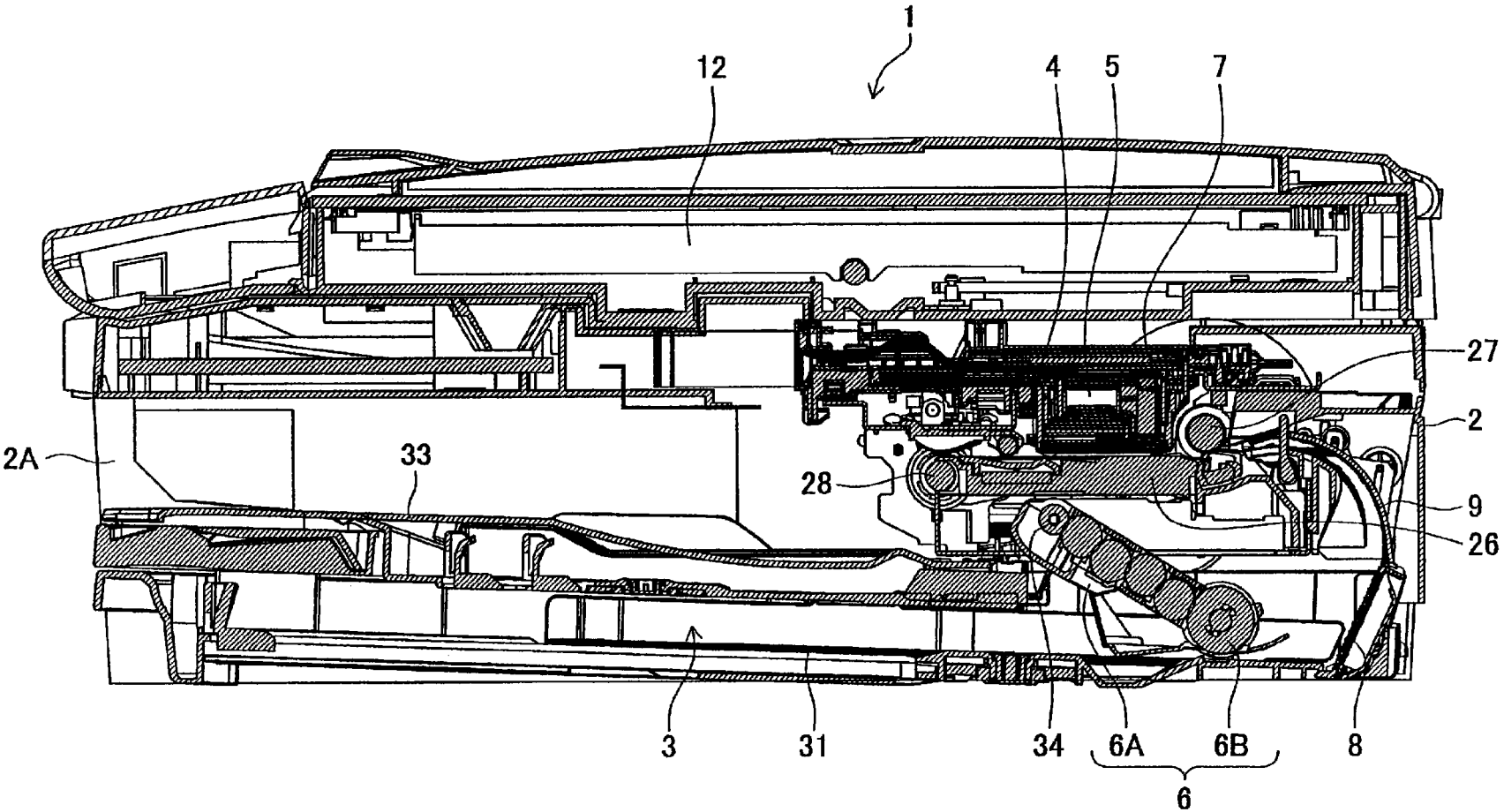
FIG. 2 is a side elevational view in cross section showing an internal structure of the image recording apparatus of FIG. 1.

As shown in FIGS. 1 and 2, the image recording apparatus 1 according to the present embodiment has a housing 2 formed by injection-molding of a synthetic resin material. An image reading device 12 which operates in the copying function and the facsimile function is disposed at an upper portion of the housing 2. It is noted that, throughout the specification, directional terminology such as "front", "rear", "left", "right", "upper", "lower", "above", "below", etc., is used with respect to an orientation of the image recording apparatus 1 disposed for its intended use.

The image reading device 12 is configured to be pivotable upward and downward about one end of the housing 2 via a hinge device not shown. An original covering member 13 covering an upper surface of the image reading device 12 is connected to a rear end of the image reading device 12 through hinges not shown, such that the original covering member 13 is pivotable upward and downward about the hinges.

Further, on the upper portion of the housing 2, there is provided an operator's control panel 14 located on a front side of the image reading device 12 and having various control buttons or keys, a liquid crystal display, etc. In the image recording apparatus 1, there are executed controls relating to various functions, such as the copying function and the scanning function, depending on manipulations of the control buttons on the control panel 14 by a user.

On the upper surface of the image reading device 12, there is provided a glass plate, not shown, on which an original or document is to be placed when the original covering member 13 is opened upward. Below the glass plate, a contact image sensor (CIS), not shown, for reading an image or the like on the original is disposed so as to be reciprocably movable in the housing 2 along a guide shaft that extends in a suitable direction.

In the housing 2 of the image recording apparatus 1, an ink storage portion, not shown, is provided. In the ink storage portion, there are accommodated four ink cartridges in which are stored respective inks of mutually different four colors, namely, black (Bk), cyan (C), magenta (M), and yellow (Y). The ink cartridges are normally connected to a recording head 4 of a recording portion 7 (as an image recording unit) in the housing 2 through respective flexible ink supply tubes. Thus, in the image recording apparatus 1, the inks in the respective ink cartridges are supplied to the recording head 4.

At a front lower portion of the housing 2, a front opening 2A is formed at which the front portion (the left-side portion) of the housing 2 is open. In the present image recording apparatus 1, a sheet-supply cassette body 3 (hereinafter referred to as "cassette body 3") as a sheet accommodating portion described below is insertable into and removable from the housing 2 through the front opening 2A, whereby the cassette body 3 is mounted on and dismounted from the image recording apparatus 1.

The cassette body 3 in the present embodiment is configured to accommodate recording sheets P, each as a recording medium, in the form of a stack of cut sheets of a selected size such as an A4 size, a letter size, a legal size or a postcard size. The cassette body 3 is capable of accommodating the recording sheets P to such an extent that the thickness of the stack of the recording sheets P accommodated in the cassette body 3 is equal to a prescribed maximum height L. The recording sheets P are accommodated in the cassette body 3 such that the width direction of each sheet P parallel to its two parallel short sides is perpendicular to a sheet-feed direction (i.e., in a rightward direction in FIG. 2) in which each sheet P is fed. The structure of the cassette body 3 will be explained in greater detail.

Figure 3:
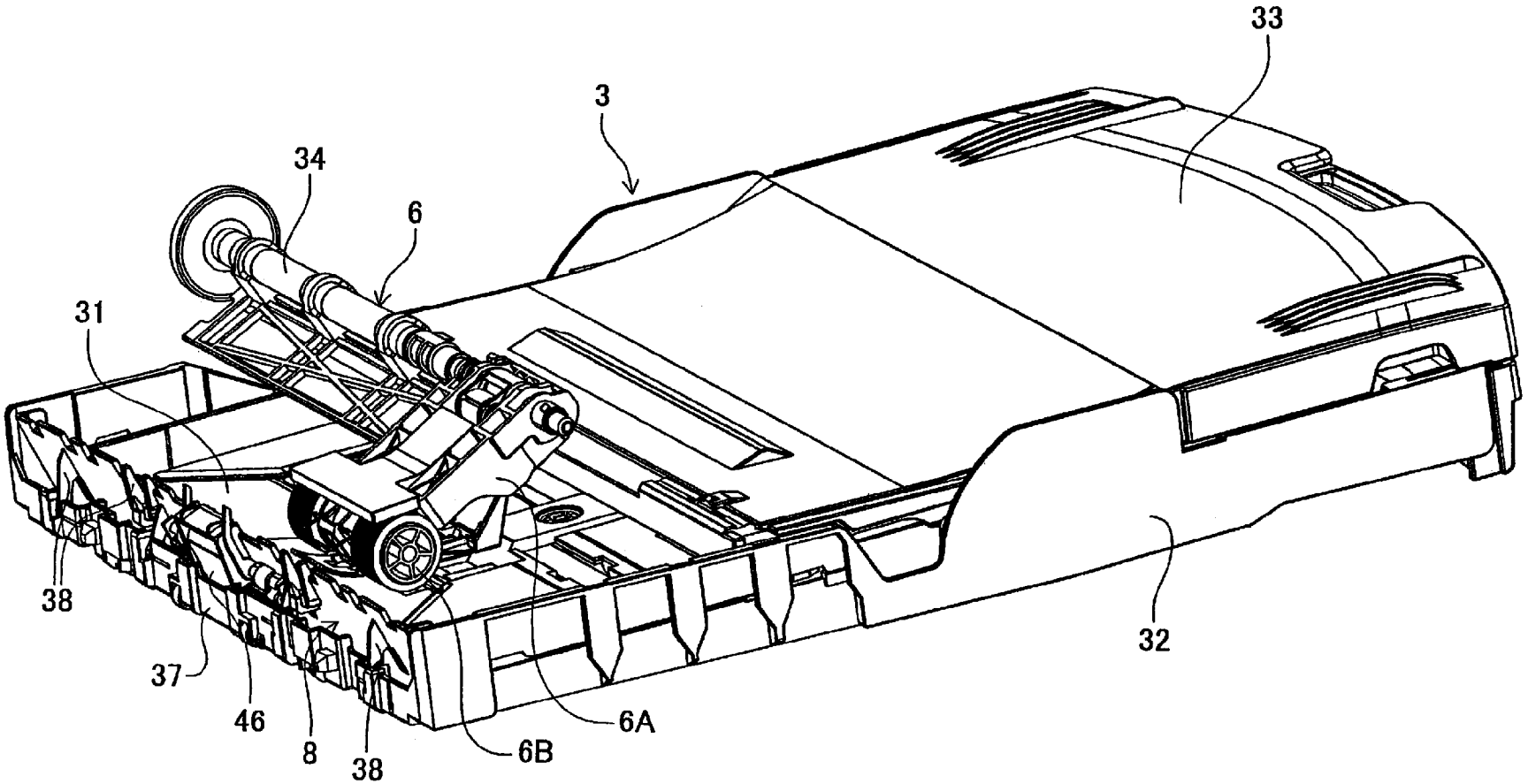
FIG. 3 is a perspective view showing a cassette body according to the embodiment of the present invention.

As shown in FIGS. 2 and 3, a sheet-feed roller unit 6 is disposed in the housing 2 above the cassette body 3 that is mounted on the image recording apparatus 1. The sheet-feed roller unit 6 includes a frame-like roller support arm 6A formed of a synthetic resin, a pair of sheet-feed rollers 6B, and a drive shaft 34. The roller support arm 6A incorporates a gear transmission mechanism and is configured to be pivotable at its proximal end about the drive shaft such that its free end is movable upward and downward.

The gear transmission mechanism includes a gear that rotates together with the drive shaft 34, a planetary gear, and a plurality of intermediate gears. The planetary gear is supported on an end of a planetary arm that rotatably engages the drive shaft 34, and meshes with the gear. The intermediate gears are for transmitting power from the planetary gear to a gear disposed at a side portion of each sheet-feed roller 6B.

An outer circumferential surface of each of the sheet-feed rollers 6B is covered with a material having a high friction coefficient, such as a rubber. The sheet-feed rollers 6B are disposed at the free end of the roller support arm 6A, and are rotatably driven in a prescribed direction corresponding to the sheet-feed direction in which the recording sheets P accommodated in the cassette body 3 are fed, by a drive force transmitted from a drive source (not shown) via the drive shaft 34 and the gear transmission mechanism in the roller support arm 6A.

In the thus constructed image recording apparatus 1, when each recording sheet P is fed, the roller support arm 6A is pivotally moved downward, so that the sheet-feed rollers 6B are brought into contact with an upper surface of an uppermost one of the recording sheets P accommodated in the cassette body 3. In this state, the sheet-feed rollers 6B are rotatably driven by the drive force transmitted thereto from the drive source, whereby the uppermost sheet is fed in the sheet-feed direction.

In the present image recording apparatus 1, the recording sheets P are separated one by one and fed in the sheet-feed direction by a cooperative action of the sheet-feed rollers 6B and separation pawls 36 provided on an inclined sheet-separation plate 8 of the cassette body 3, as explained below in detail.

One of the recording sheets P separated by the cooperative action of the sheet-feed rollers 6B and the separation pawls 36 is fed from the cassette body 3 toward a sheet-feed path 9. The sheet-feed path 9 is given by a spacing defined by a first feed-path defining member and a second feed-path defining member, and includes a U-turned portion. The first feed-path defining member defines an outer periphery of the U-turned portion of the sheet-feed path 9 while the second feed-path defining member defines an inner periphery of the U-turned portion. The first and second feed-path defining members cooperate with each other to constitute a sheet-feed-direction changing portion. Each recording sheet P is fed through the sheet-feed path 9 such that a centerline of the sheet P in its width direction is aligned with a centerline of the sheet-feed path 9 in its width direction that is perpendicular to the sheet-feed direction.

Each of the sheets P fed by the sheet-feed roller unit 6 reaches the recording portion 7 located above the cassette body 3 via the sheet-feed path 9. The recording portion 7 is located, above the cassette body 3 in the housing 2, between a box-like main frame and a first and second guide members (not shown) that are fixedly supported by a pair of side plates of the main frame. Each of the first and second guide members is an elongate plate extending in a main scanning direction of the recording head 4. The first guide member is disposed on a more upstream side in the sheet-feed direction than the second guide member.

A carriage 5 is slidably supported by the first and second guide members so as to bridge those two guide members, such that the carriage 5 is reciprocable in the main scanning direction of the recording head 4. The recording head 4 of an ink-jet type is mounted on the carriage 5, and its nozzles formed in a lower surface of the recording head 4 are open downward.

Here, as shown in FIG. 2, the feeding direction of each recording sheet P before passing through the U-turned portion of the sheet-feed path 9 is changed by 180 degrees after having passed through the U-turned portion. Accordingly, the sheet P is turned upside down after having passed through the U-turned portion of the sheet-feed path 9. More specifically described, where the recording sheets P are accommodated in the cassette body 3 such that the recording surface of each sheet, e.g., the surface of the glossy paper on which the coating layer is formed, faces downward, the recording surface of the sheet P faces upward when the sheet P reaches the recording portion 7. In this state, the recording surface of the sheet P is opposed to the lower surface of the recording head 4 in which the nozzles are formed, and an image or the like is recorded on the recording surface of the sheet P.

On an upper surface of the second guide member, there is disposed a timing belt (not shown) that extends in the main scanning direction of the recording head 4. On a lower surface of the second guide member, there is fixed a carriage motor (not shown) for driving the timing belt. In the thus constructed image recording apparatus 1, the carriage motor is driven, whereby the carriage 5 is reciprocated through the timing belt. A flat platen 26 is fixed to the main frame so as to be located between the first and second guide members. The platen 26 is disposed so as to be opposed to the nozzle surface of the recording head 4.

On an upstream side of the platen 26 in the sheet-feed direction, a drive roller 27 and a driven roller are disposed. The drive roller 27 functions as a conveying or registering roller for conveying each sheet P to a position which is below the recording head and on the platen 26. The driven roller is disposed below the drive roller 27 so as to be opposed to the same 27, and rotates in accordance with rotation of the drive roller 27.

On a downstream side of the platen 26 in the sheet-feed direction, a sheet-discharge roller 28 and a spur roller are disposed. The sheet-discharge roller 28 is driven to convey the sheet P on which an image has been recorded, to a sheet-discharge tray 33. The spur roller is rotatably disposed so as to be opposed to the sheet-discharge roller 28 and is biased toward the sheet-discharge roller 28.

Accordingly, in the present image recording apparatus 1, each sheet P accommodated in the cassette body 3 with its recording surface facing downward is fed from the cassette body 3 by the sheet-feed rollers 6B that are rotatably driven, and reaches the drive roller 27 via the sheet-feed path 9. After having passed through the U-turned portion of the sheet-feed path 9, the sheet P is turned upside down, so that the feeding direction of the sheet P is changed by 180 degrees. Accordingly, the recording surface of the sheet P after having passed through the U-turned portion of the sheet-feed path 9 faces upward and is opposed to the nozzle surface of the recording head 4.

Subsequently, the sheet P is fed further in the sheet-feed direction, i.e., in a leftward direction in FIG. 2, by the sheet-feed rollers 6B and the drive roller 27, and then reaches the sheet-discharge roller 28. The recording head 4 ejects ink droplets onto the recording surface of the sheet P, so that an intended image desired by the user is recorded. Thereafter, the sheet P on which the image has been recorded is discharged to the sheet-discharge tray 33 by the sheet-discharge roller 28. In this respect, the sheet-discharge roller 28 mainly constitutes a sheet discharger. Thus, in the present image recording apparatus 1, the user's intended image is recorded on the recording surface of the sheet P.

Figure 4:
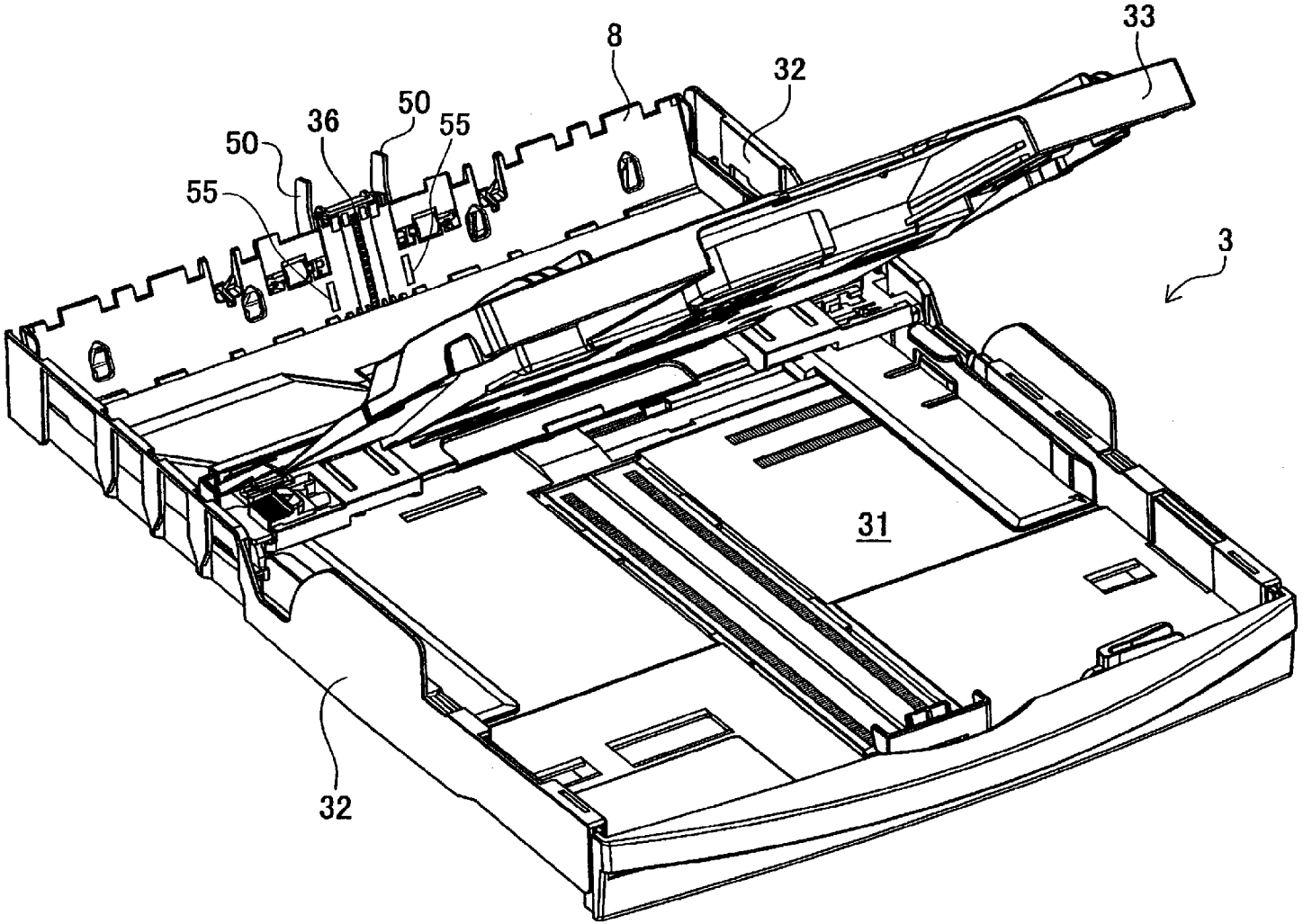
FIG. 4 is a perspective view showing the cassette body when a sheet-discharge tray is pivoted upward.

Next, there will be explained in detail the structure of the cassette body 3 according to the present embodiment with reference to FIGS. 3 and 4. The cassette body 3 as one constituent component of the present sheet-feed device includes a bottom plate 31 on which the recording sheets P are stacked. Two side plates 32, 32 are formed so as to extend upright from opposite side edge portions of the bottom plate 31 that are parallel to the sheet-feed direction. At a downstream end of the bottom plate 31 in the sheet-feed direction, the inclined sheet-separation plate 8 is disposed so as to be inclined, with respect the bottom plate 31, at a prescribed angle, i.e., at a second angle β described below.

The sheet-discharge tray 33 disposed above the cassette body 3 is attached to the cassette body 3 such that the sheet-discharge tray 33 bridges the side plates 32 to cover an upstream portion of the stack of the sheets P placed on the bottom plate 31. As shown in FIG. 4, the sheet-discharge tray 33 is attached to the cassette body 3 such that the sheet-discharge tray 33 pivots about a pivot axis (not shown) so as to open upward and close downward. That is, the sheet-discharge tray 33 is pivotally opened upward, whereby the user can easily place the sheets P on the bottom plate 31 of the cassette body 3.

At a downstream portion of the bottom plate 31, two sheet-width guides are disposed so as to be movable in mutually opposite directions perpendicular to the sheet-feed direction, in accordance with the width of the sheets P. That is, the sheet-width guides permit the sheets P to be placed on the bottom plate 31 symmetrically with respect to the widthwise centerline of the cassette body 3, and guide each sheet P appropriately in the sheet-feed direction.

Next, the inclined sheet-separation plate 8 disposed on the cassette body 3 will be explained with reference to FIGS. 2-6. The inclined sheet-separation plate 8 for separating the sheets P is removably attached to a rear end of the cassette body 3, i.e., to a right-side end of the cassette body 3 in FIG. 2.

The inclined sheet-separation plate 8 is formed by injection molding of a synthetic resin material and has a convexly curved shape in its plan view in which a middle portion of the inclined sheet-separation plate 8 in the width direction of the sheets P or the cassette body 3 protrudes while opposite end portions of the inclined sheet-separation plate 8 are retracted as they extend toward the widthwise opposite ends of the sheets P. Accordingly, only a widthwise middle portion of the leading edge of the sheet P is to contact the middle portion of the inclined sheet-separation plate 8.

On a rear surface of the inclined sheet-separation plate 8, a plurality of rear support portions 38 each having a generally triangular shape are provided so as to be suitably spaced apart from each other in the width direction of the cassette body 3. The rear support portions 38 are configured to abut on a rear-side plate 37 of the cassette body 3 in a state in which the inclined sheet-separation plate 8 is attached to the cassette body 3. The rear support portions 38 cooperate with the rear-side plate 37 to prevent the inclined sheet-separation plate 8 from being deformed due to the feeding of the sheets P.

At the middle portion of the inclined sheet-separation plate 8 in the width direction of the cassette body 3, a plurality of window holes are formed so as to be arranged in a row along the sheet-feed direction. On the rear surface of the inclined sheet-separation plate 8 at the middle portion thereof in which the window holes are formed, there is attached a box-like mounting case 46 shown in FIG. 6 in which a separation member 11 explained below is accommodated.

Figure 7A:
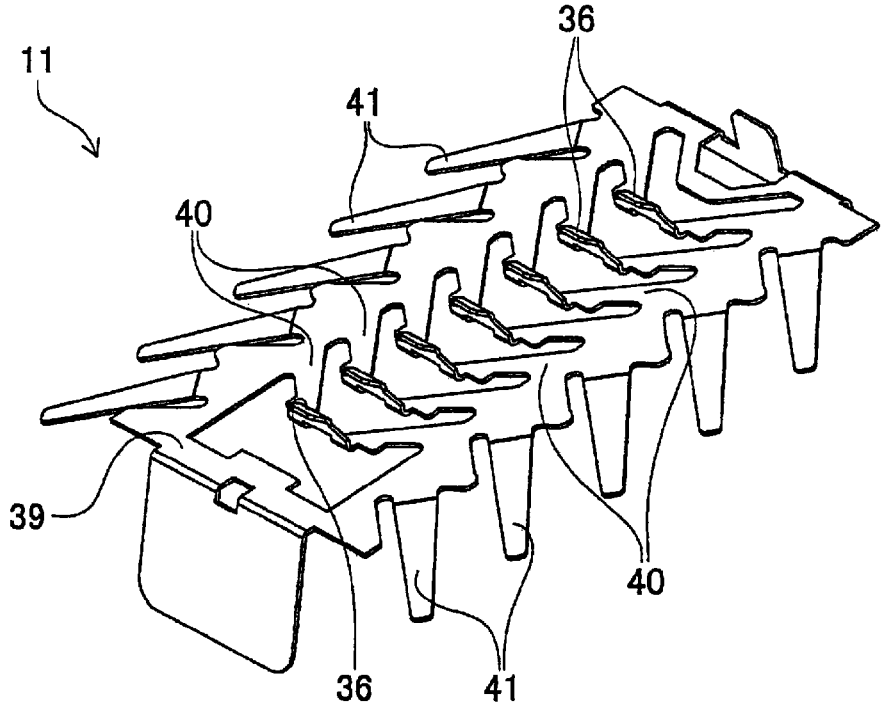
FIGS. 7A and 7B are views each showing a separation member disposed in a mounting case of the inclined sheet-separation plate.
Figure 7B:
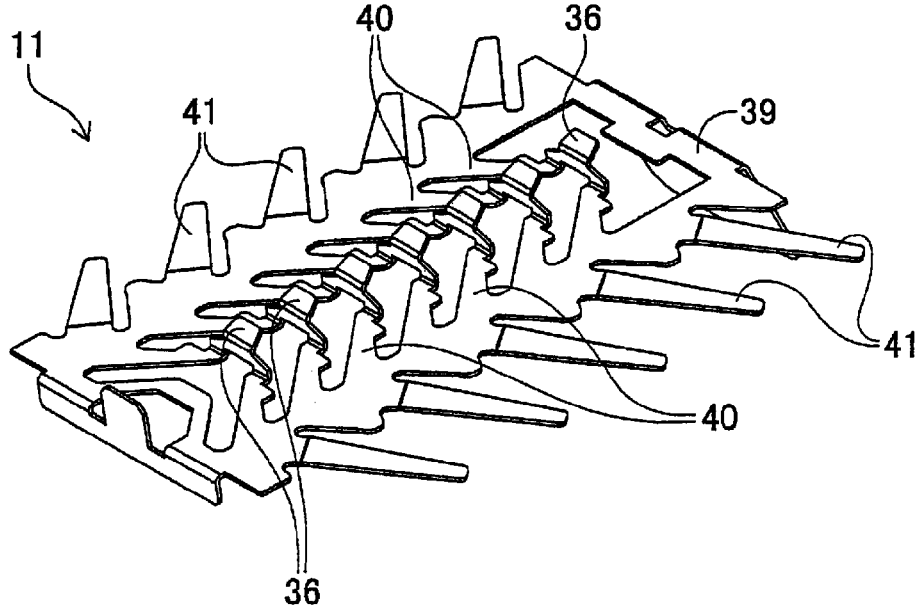

With reference to FIGS. 7A and 7B, the separation member 11 will be explained. The separation member 11 is formed of a metal plate such as stainless, and includes a flat base portion 39, arm portions 40, separation pawls 36, and elastic leg portions 41. The arm portions 40 formed on the base portion 39 have an inverted V shape extending toward a centerline of the base portion 39.

Each separation pawl 36 is a pawl-like piece formed by bending a free end of a corresponding one of the arm portions 40 at its central portion such that the separation pawl 36 comes into contact with the sheet P. The separation pawls 36 are arranged at suitable intervals that correspond to intervals at which the window holes formed in the inclined sheet-separation plate 8 are arranged. Each separation pawl 36 is bent not perpendicularly with respect to the base portion 39 but at a suitable inclined angle. That is, when the separation member 11 is attached to the inclined sheet-separation plate 8, the separation pawls 30 protrude into a feeding route of the sheet P (hereinafter referred to as "sheet feeding route" where appropriate), namely, onto a front surface of the inclined sheet-separation plate 8, while being inclined, with respect to the sheet-separation plate 8, toward a downstream portion of the inclined sheet-separation plate 8. In the sheet-feed path 9, the sheet P is fed on the feeding route. The thus configured separation pawls 36 are to come into sliding contact obliquely with leading edges of the sheets P being fed and give an appropriate resistance to the sheets P without giving an excessive resistance thereto. Owing to the resistance given to the leading edges of the sheets P, the sheets P are separated from each other, and only the uppermost sheet is fed.

Figure 9:
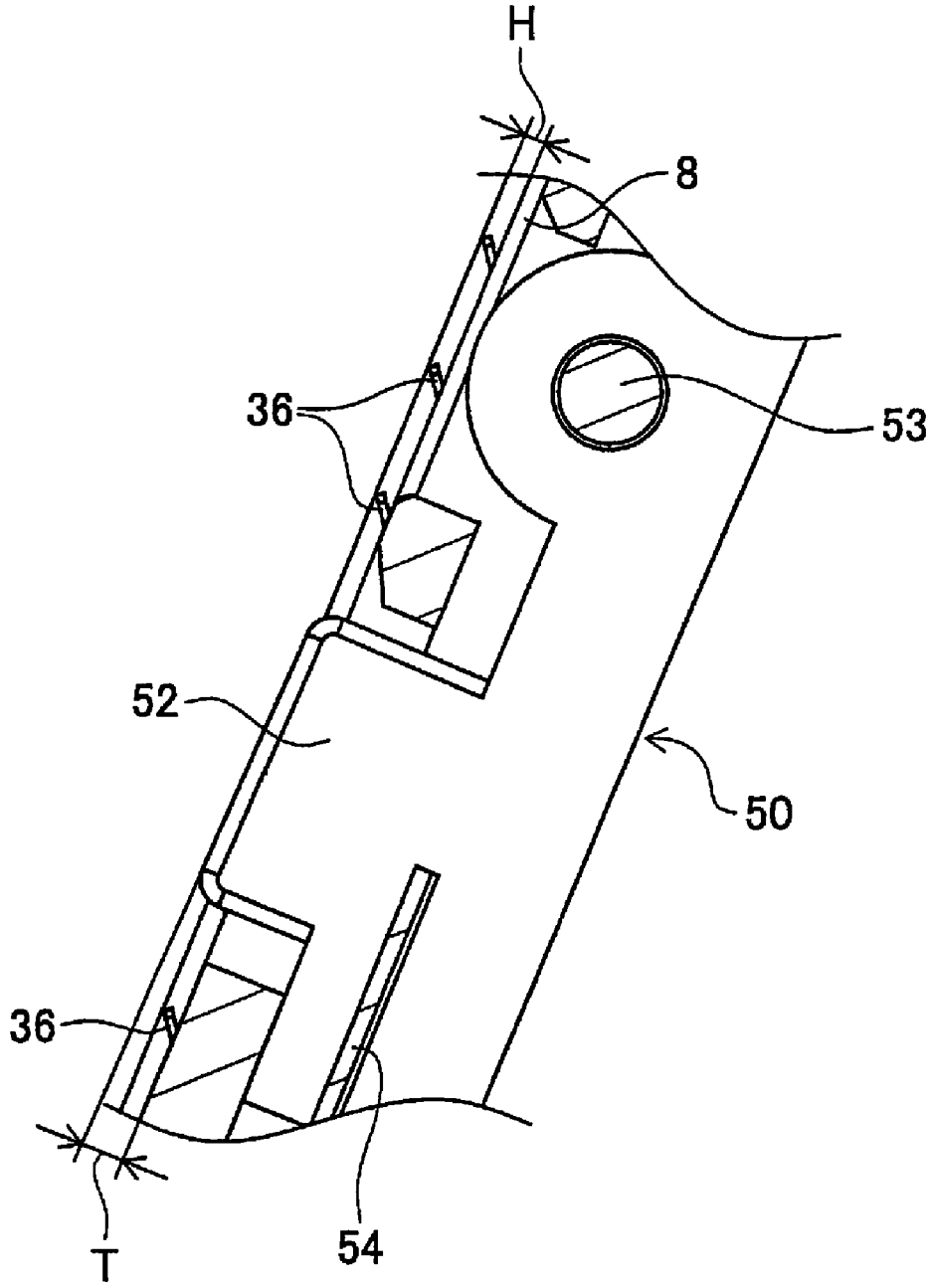
FIG. 9 is an explanatory view indicating a relationship between an amount of protrusion of separation pawls and an amount of protrusion of a second contact portion of the sheet guide member.
Figure 10A:
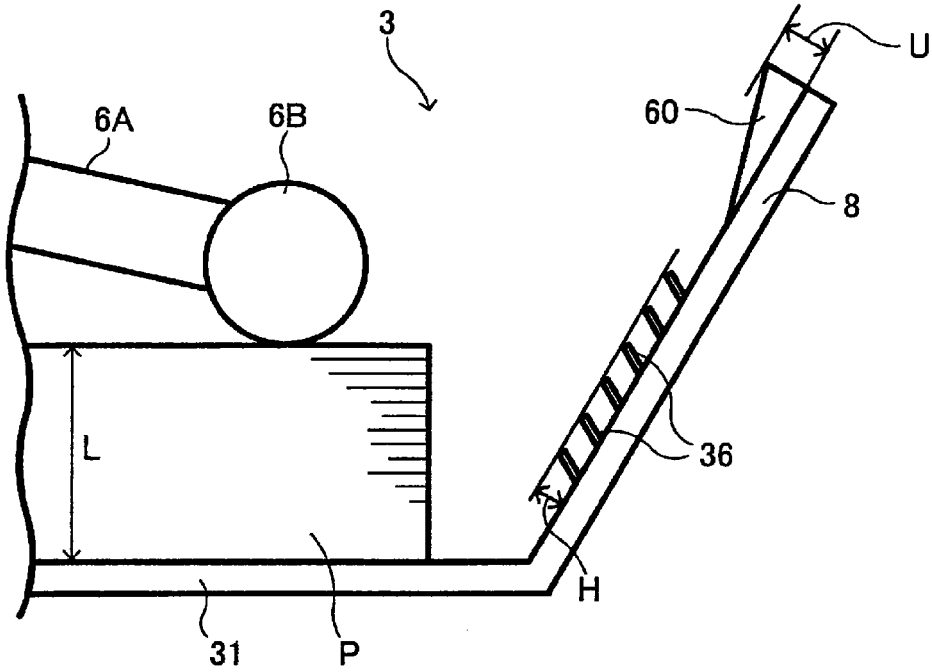
FIGS. 10A and 10B are explanatory views relating to a slant portion formed on the inclined sheet-separation plate.
Figure 10B:
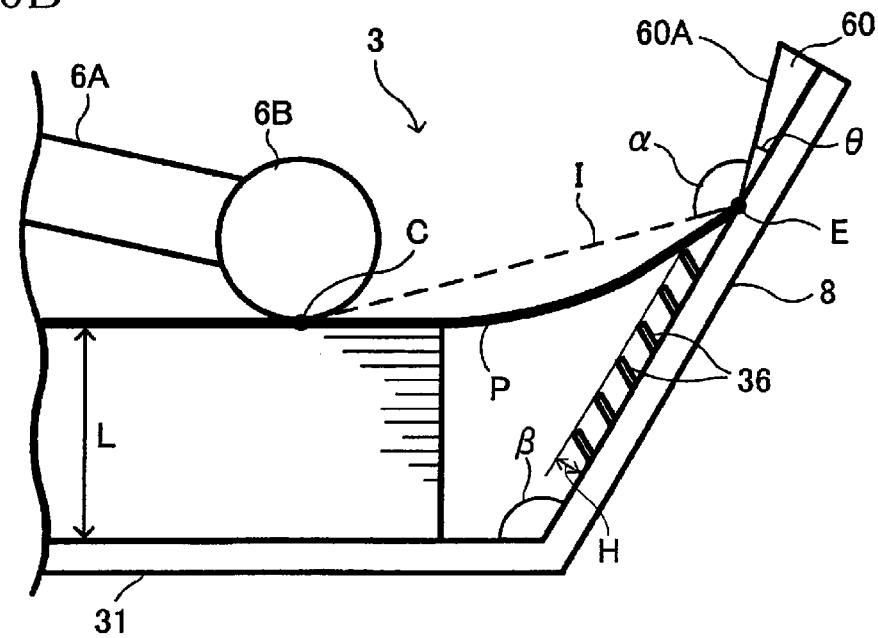

The elastic leg portions 41 are formed to extend outwardly from the base portion 39 and are configured to come into abutting contact with an inner wall of the mounting case 46 at their leading edges. Accordingly, the separation member 11 is attached to the inclined sheet-separation plate 8 such that the entirety of the base portion 39 of the separation member 11 comes into close contact with the rear surface of the inclined sheet-separation member 8, owing to the elasticity of the elastic leg portions 41. In the arrangement, the separation pawls 36 protrude, through the corresponding window holes, into the sheet feeding route, i.e., onto the front surface of the inclined sheet-separation plate 8 on which the sheet P is fed, by a prescribed amount and, therefore, the separation pawls 36 do not suffer from variations in the amount of protrusion thereof from the front surface of the inclined sheet-separation plate 8. Here, the amount of protrusion of the separation pawls 36 from the front surface of the inclined sheet-separation plate 8 is hereinafter referred to as "protrusion amount H", as shown in FIGS. 9, 10A, and 10B.

Figure 5:
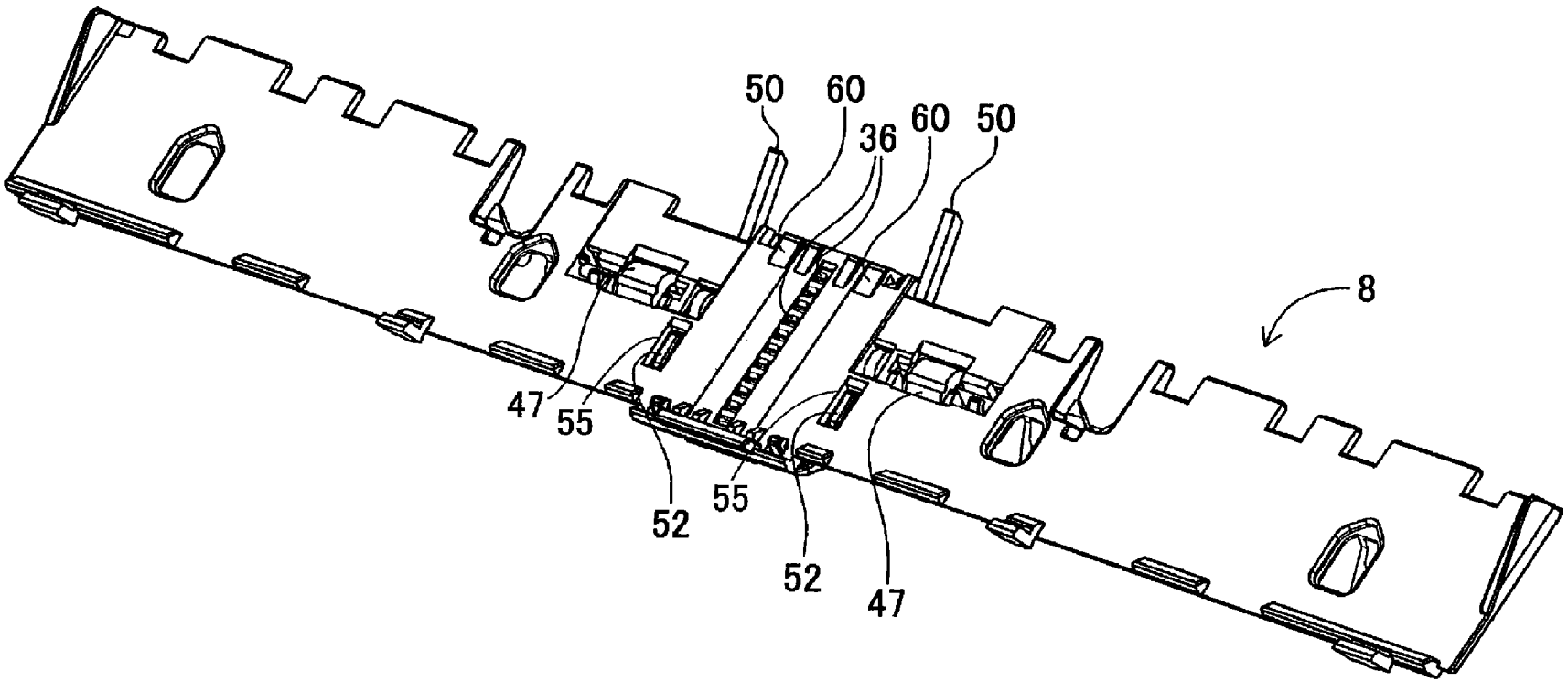
FIG. 5 is a perspective view showing an inclined sheet-separation plate.

As described above, the inclined sheet-separation plate 8 is formed, at its middle portion, with the plurality of window holes through which the separation pawls 36 protrude onto the front surface of the inclined sheet-separation plate 8 by the prescribed protrusion amount H. As shown in FIG. 5, at an upper end of the middle portion of the inclined sheet-separation plate 8, there are formed two slant portions 60 each of which has a slant surface 60A that slants at a prescribed slant angle θ (FIG. 10B) with respect to the inclined sheet-separation plate 8, strictly, with respect to a body of the inclined sheet-separation plate 8. Each slant portion 60 has a height dimension at its highest position as measured from the front surface of the inclined sheet-separation plate 8, larger than the protrusion amount H of the separation pawls 36. The height dimension of the slant portion 60 is hereinafter referred to as "height U". Here, an apex of angle defined by each slant surface 60A and the front surface of the inclined sheet-separation plate 8, i.e., an apex of the slant angle θ, is hereinafter referred to as "slant angle apex E". In other words, the slant angle apex E is an intersection point of the slant surface 60A and the front surface of the inclined sheet-separation plate 8.

Figure 6:
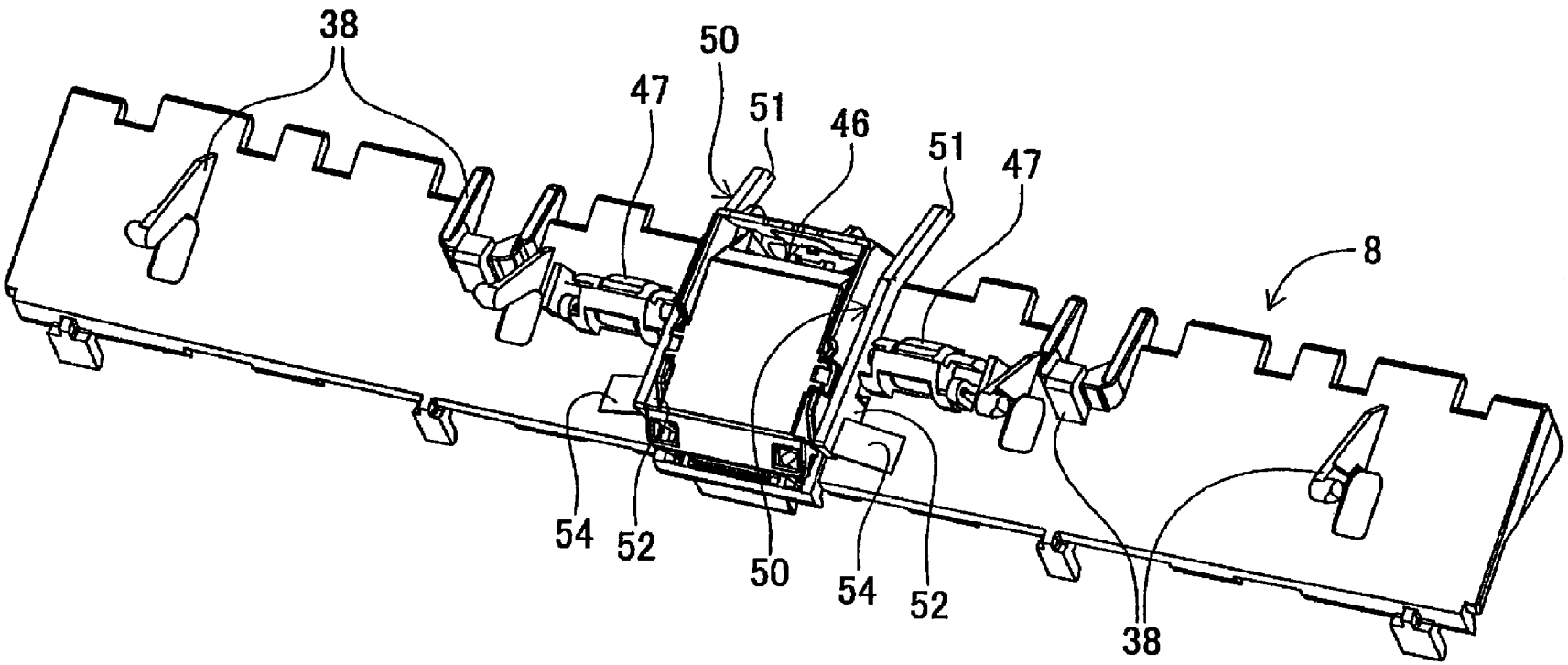
FIG. 6 is a perspective view of the inclined sheet-separation plate viewed from its rear side.
Figure 8B:
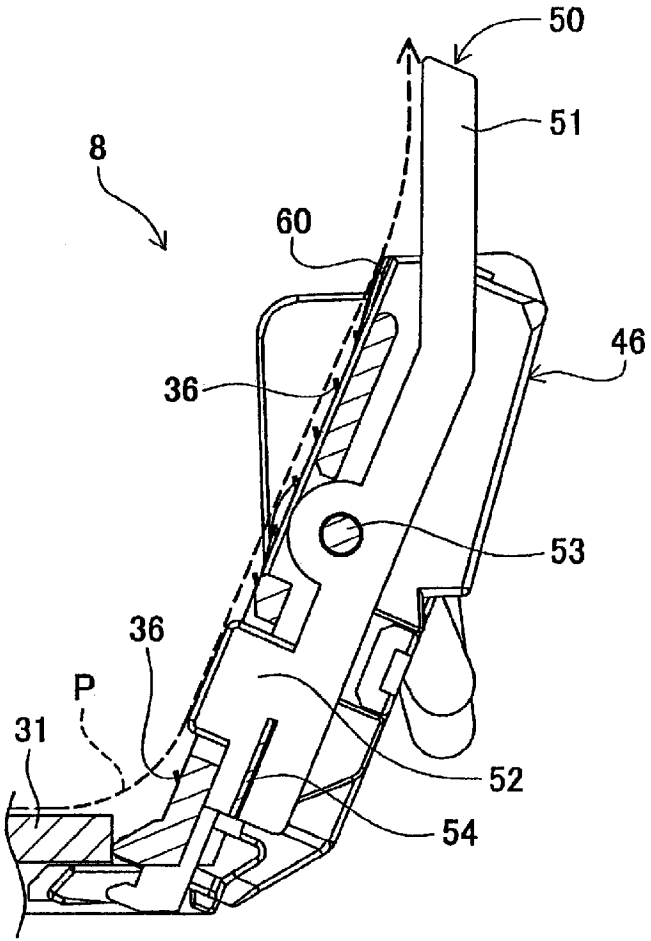
FIGS. 8A and 8B are side elevational views in cross section each for explaining a movement of a sheet guide member.
Figure 8A:
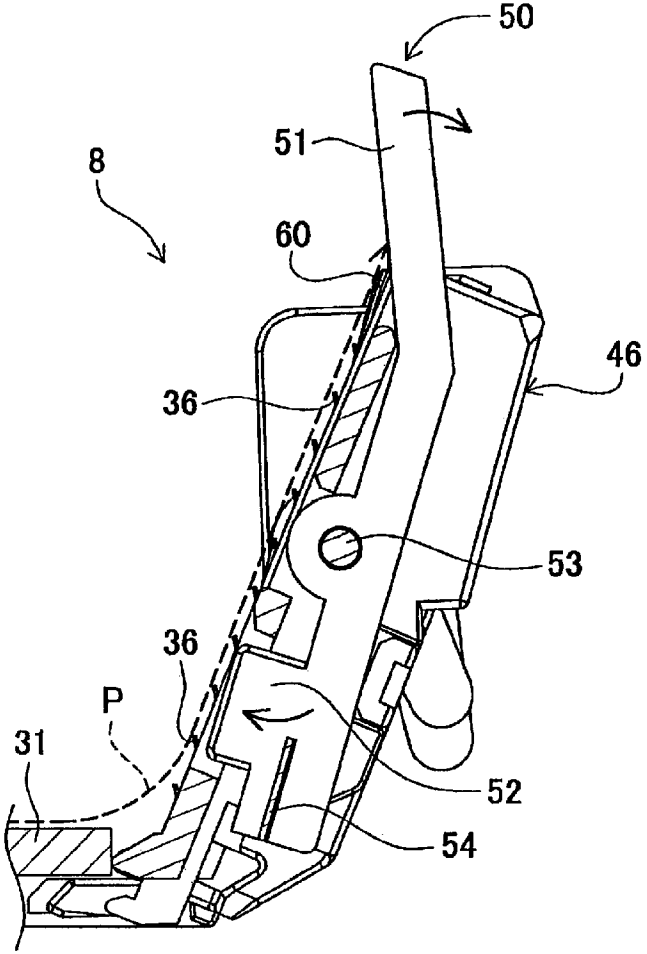

As shown in FIG. 6, two sheet guide members 50, 50 are supported on the rear surface of the inclined sheet-separation plate 8 on opposite sides of the mounting case 46 that are parallel to the sheet-feed direction, so as to pivot about a shaft 53 defining a pivot axis, as shown in FIG. 6. Each sheet guide member 50 includes a first contact portion 51 and a second contact portion 52. The first contact portion 51 extends beyond the upper end of the inclined sheet-separation plate 8 and is configured to come into contact with the leading edge of the sheet P being fed. The second contact portion 52 is configured to protrude from an opening 55 (FIGS. 4 and 5) formed in the inclined sheet-separation plate 8 and to come into contact with the recording surface of the sheet P when the sheet guide member 50 pivots about the shaft 53 as explained below. As shown in FIG. 8, each sheet guide member 50 is structured such that a length of the first contact portion 51, namely, a distance from the shaft 53 to an end of the first contact portion 51, is larger than a length of the second contact portion 52, namely, a distance from the shaft 53 to an end of the second contact portion 52. Further, each sheet guide member 50 is provided with a leaf spring 54 disposed in the vicinity of the second contact portion 52. The leaf spring 54 exerts, on the sheet guide member 50, a biasing force by which the sheet guide member 50 is normally kept located at a prescribed position shown in FIG. 8A.

As shown in FIGS. 5 and 6, rollers 47 are rotatably supported on the inclined separation plate 8 on the respective opposite sides of the row of the separation pawls 36. Each of the rollers 47 is disposed such that a part of its outer circumferential surface is present or located on the sheet feeding route. In the present image recording apparatus 1, therefore, the sheet P can be smoothly fed owing to rotation of the rollers 47.

The sheet-feed device according to the present embodiment includes the cassette body 3, the sheet-feed rollers 6B, the sheet guide members 50. There will be next explained the function of each sheet-guide member 50 as one constituent component of the present sheet-feed device, with reference to FIGS. 8A and 8B showing a movement of the sheet guide member 50. As described above, each sheet guide member 50 is normally kept located at the position shown in FIG. 8A by the biasing force of the leaf spring 54. In this state, the first contact portion 51 of each sheet guide member 50 is located on the feeding route of the sheet P above the inclined sheet-separation plate 8 while the second contact portion 52 is located in the opening 55 formed in the inclined sheet-separation plate 8 without protruding onto the feeding route. That is, each sheet guide member 50 is located at the position shown in FIG. 8A when no external force except the biasing force of the leaf spring 54 is applied to the sheet guide member 50.

When the sheets P accommodated in the cassette body 3 start to be fed by the sheet-feed roller unit 6, the sheets P are fed toward the inclined sheet-separation plate 8 along the feeding route indicated by a broken line in FIGS. 8A and 8B. In this instance, the leading edge of each sheet P comes into contact sequentially with the separation pawls 36 that protrude by the protrusion amount H. Accordingly, even where two or more of the sheets P are fed at one time, namely, even where the multi-feeding occurs, the sheets P can be separated and fed one by one.

Where one of the sheets P separated from the other sheets as described above is fed, the leading edge of that one sheet P comes into contact with the first contact portions 51 of the respective sheet guide members 50 that are located on the feeding route. As a result of the contact of the one sheet P with the first contact portions 51, each sheet guide member 50 pivots about the corresponding shaft 53 against the biasing force of the corresponding leaf spring 54. More specifically described with reference to FIG. 8A, the sheet P being fed allows each sheet guide member 50 to pivot such that the first contact portion 51 moves away from the rear surface of the inclined sheet-separation plate 8 and such that the second contact portion 52 moves toward the feeding route, namely, protruding from the front surface of the inclined sheet-separation plate 8.

Subsequently when the sheet P is further fed, the recording surface of the sheet P comes into contact with an end of the first contact portion 51 of each sheet guide member 50, whereby the sheet guide member 50 completely pivots about the corresponding shaft 53, and the second contact portion 52 of each sheet guide member 50 protrudes onto the sheet feeding route by a prescribed amount T through the corresponding opening 55 formed in the inclined sheet-separation plate 8, as shown in FIGS. 8B and 9. In this state, since the sheet P is being fed on the front surface of the inclined sheet-separation plate 8, the recording surface of the sheet P is lifted up away from the front surface of the inclined sheet-separation plate 8 by a distance corresponding to the protrusion amount T by which the second contact portion 52 of each sheet guide member 50 protrudes from the front surface of the inclined sheet-separation plate 8.

In the present embodiment, the protrusion amount T of the second contact portion 52 of each sheet guide member 50 is made larger than the protrusion amount H of each separation pawl 36, as shown in FIG. 9. Accordingly, when the sheet P is lifted up away from the inclined sheet-separation plate 8 by the distance corresponding to the protrusion amount T of each second contact portion 52 as a result of the pivotal movement of the sheet guide members 50, the sheet P is consequently located at a position away from the inclined sheet-separation plate 8 by the distance corresponding to the protrusion amount T of the second contact portion 52 that is larger than the protrusion amount H of the separation pawl 36. Accordingly, the sheet P is fed away from the tips of the separation pawls 36. Thus, in the present image recording apparatus 1, the recording surface of the sheet P being fed is prevented from contacting the separation pawls 36, whereby the recording surface of the sheet P is prevented from being damaged due to otherwise possible contact with the separation pawls 36.

According to the arrangement, the first contact portions 51 of the respective sheet guide members 50 are surely located on the feeding route upon feeding of each sheet P, so that the sheet P fed by the sheet-feed rollers 6B comes into contact with the first contact portions 51 with high reliability, thereby pivoting the sheet guide members 50. Further, the pivotal movement of the sheet guide members 50 permits the respective second contact portions 52 to protrude onto the feeding route, so that the sheet P being fed is moved away from the separation pawls 36, thus preventing the sheet P from being damaged by the separation pawls 36. Moreover, owing to the biasing force of the leaf spring 54, the sheet guide members 50 are placed, prior to the feeding of the sheets P, in a state in which the protrusion amount T of the respective second contact portions 52 from the inclined sheet-separation plate 8 is smaller than the protrusion amount H of the separation pawls 36 from the same 8, namely, in a state in which the second contact portions 52 do not protrude onto the sheet feeding route. Accordingly, prior to the feeding of the sheets P, the second contact portions 52 do not hinder the leading edge of each sheet P and the separation pawls 36 from contacting each other. Therefore, even where the multi-feeding occurs, the sheets P can be separated one by one by the separation pawls 36 with high reliability.

Further, since the length of the first contact portion 51 of each sheet guide member 50 is made larger than the length of the second contact portion 52 thereof, there is generated moment in each sheet guide member 50 to pivot the first contact portion 51 in the direction away from the inclined sheet-separation plate 8 even where the first and second contact portions 51, 52 are subjected to substantially the same degree of external force by the sheet P being fed. More specifically explained, the sheet guide members 50 constructed according to the present embodiment can be surely pivoted toward the prescribed direction upon feeding of the sheet P, whereby the sheet P can be moved away from the tips of the separation pawls 36. Accordingly, in the present image recording apparatus 1, the recording surface of the sheet P can be prevented from being damaged by the separation pawls 36.

Further, the sheet guide members 50 are pivotably disposed respectively on the opposite sides of the row of the separation pawls 36 arranged at the middle portion of the inclined separation plate 8. When the sheet guide members 50 are pivoted by the sheet P being fed, the sheet guide members 50 move respective portions of the sheet P near the opposite sides of the row of the separation pawls 36 away from the inclined sheet-separation plate 8 by the distance larger than the protrusion amount H of the separation pawls 36. Accordingly, those portions of the sheet P that would otherwise possibly come into contact with the separation pawls 36 can be surely moved away from the tips of the separation pawls 36, whereby the recording surface of the sheet P is prevented from being damaged.

Next, there will be explained the function of the slant portions 60 with reference to FIGS. 10A and 10B. As shown in FIG. 10A, each slant portion 60 is configured such that its height U as measured from the front surface of the inclined sheet-separation plate 8 is larger than the protrusion amount H of each separation pawl 36 as measured from the same 8.

When each sheet P is fed by the sheet-feed roller unit 6, the sheet P moves along and on the slant surfaces 60A at the upper end portion of the inclined sheet-separation plate 8. Accordingly, the sheet P is fed, at the upper end portion of the inclined sheet-separation plate 8, so as to be apart from the front surface of the inclined sheet-separation plate 8 by a distance corresponding to the height U of the slant portions 60. In other words, the sheet P is fed and transferred, at the upper end portion of the inclined sheet-separation plate 8, so as to be apart from the tips of the separation pawls 36. Thus, the recording surface of the sheet P being fed is prevented from coming into contact with and accordingly being damaged by the tips of the separation pawls 36.

Further, on the downstream side of the upper end portion of the inclined sheet-separation plate 8, the sheet P is guided by the second contact portions 52 of the respective sheet guide members 50, so as to be apart from the front surface of the inclined sheet-separation plate 8 by the distance corresponding to the protrusion amount T of the second contact portions 52. That is, in the present embodiment, the sheet P is fed apart from the tips of the separation pawls 36 having the protrusion amount H, at upper and lower portions of the row of the separation pawls 36 owing to the slant portions 60 and the second contact portions 52, respectively. Accordingly, the entirety of the sheet P is fed to be apart from the tips of the separation pawls 36, whereby the present image recording apparatus 1 is capable of preventing the recording surface of the sheet P from coming into contact with and accordingly being damaged by the separation pawls 36.

In the present embodiment, each of the slant portions 60 is formed such that an angle (a first angle $\alpha$) defined by an imaginary plane I and the slant surface 60A is not smaller than an angle (a second angle $\beta$) defied by the bottom plate 31 of the cassette body 3 and the front surface of the inclined sheet-separation plate 8. The imaginary plane I will be explained with reference to FIG. 10B while focusing on one sheet-feed roller 6B and one slant portion 60 where appropriate, for easier understanding. The imaginary plane I includes: the above-described slant angle apex E; and a contact point C of the sheet-feed roller 6B and the uppermost sheet in the stack of the sheets P when accommodated in the cassette body 3 to the maximum height L. As explained above, the slant angle apex E is an apex of the slant angle $\theta$ that is defined by the front surface of the inclined sheet-separation plate 8 and the slant surface 60A, namely, the slant angle apex E is a boundary between the front surface of the inclined sheet-separation plate 8 and the slant portion 60. Accordingly, the imaginary plane I defines the shortest feeding route on which the sheet P contacting the sheet-feed roller 6B at the contact point C is fed to reach the slant portion 60.

As described above, the sheet P reached the slant portions 60 is fed along or on the slant surfaces 60A thereof. Accordingly, the first angle $\alpha$ indicates a degree of a change or shift of the feeding direction of the sheet P before and after the sheet P reaches the slant portions 60. A smaller first angle $\alpha$ means a more abrupt or steeper change of the feeding direction.

As explained above, the second angle $\beta$ is an angle defined by the bottom plate 31 of the cassette body 3 and the front surface of the inclined sheet-separation plate 8. Where the sheets P stacked in the cassette body 3 decrease, each sheet P fed by the sheet-feed roller unit 6 is transferred along the surface of the bottom plate 31. The sheet P then reaches the inclined sheet-separation plate 8 and is thereafter transferred along or on the front surface of the inclined sheet-separation plate 8. Accordingly, the second angle $\beta$ indicates a degree of a change or a shift of the feeding direction of the sheet P before and after the sheet P reaches the inclined sheet-separation plate 8. In this respect, the second angle $\beta$ does not change or vary since the inclined sheet-separation plate 8 is fixed to the bottom plate 31.

In the present embodiment, each slant portion 60 is configured such that the first angle $\alpha$ is not smaller than the second angle $\beta$. As shown in FIG. 10B, the uppermost sheet P located uppermost among the sheets P that are accommodated in the cassette body 3 at the maximum height L is actually transferred below the imaginary plane I. In this instance, an angle defined by the surface of the sheet P and each slant portion 60A at a time point when the sheet P reaches the slant portions 60 is larger than the first angle $\alpha$. Accordingly, the degree of change of the feeding direction before and after the sheet P reaches the slant portions 60 does not become more abrupt than the degree of change of the feeding direction before and after the sheet P reaches the inclined sheet-separation plate 8. In the present embodiment, therefore, the provision of the slant portions 60 does not hinder the feeding of the sheet P and the function of the separation pawls 36 to separate two or more sheets that are fed at one time. As described above, since the bottom plate 31 of the cassette body 3, the inclined sheet-separation plate 8, and the slant portions 60 are constructed such that the above-indicated first angle $\alpha$ is not smaller than the above-described second angle $\beta$, the sheet feeding condition when the sheet P is fed on the slant portions 60 is made similar to that when the sheet P is fed on the inclined sheet-separation plate 8.

Further, even where the sheets P are accommodated in the cassette body 3 at the maximum height L, the degree of change of the feeding direction of the sheet P before and after the sheet P reaches the slant portions 60 becomes not smaller than the second angle $\beta$. Accordingly, even where the height of the stack of the sheets P accommodated in the cassette body 3 is smaller than the maximum height L, the degree of change of the feeding direction before and after the sheet P reaches the slant portions 60 becomes not smaller than the second angle $\beta$, so that the feeding of the sheet P is not hindered.

Explained in more detail, where the height of the stack of the sheets P accommodated in the cassette body 3 is smaller than the maximum height L, the sheet P is fed toward the inclined sheet-separation plate 8 at a height level lower than the maximum height L, namely, nearer to the bottom plate 31. That is, the sheet P is transferred from the lower height level toward the slant portions 60 along the front surface of the inclined sheet-separation plate 8. Therefore, the feeding direction upon reaching the slant portions 60 in an instance where the sheet P is fed from the low height level follows more closely the front surface of the inclined sheet-separation plate 8 than in an instance where the sheet P is fed form the maximum height L. Accordingly, an angle defined by the feeding direction prior to reaching each slant portion 60 and the feeding direction after reaching each slant portion 60 in the instance where the sheet P is fed from the low height level is larger than the angle in the instance where the sheet P is fed from the maximum height L and, at the same time, larger than the first angle α. Therefore, even in the instance where the sheet P is fed from the low height level, the degree of change of the feeding direction before and after the sheet P reaches the slant portions 60 becomes smaller than that in the instance where the sheet P is fed from the maximum height L, whereby the feeding of the sheet P is not hindered.

As explained above, the present image recording apparatus 1 is capable of surely preventing the recording surface of the sheet P from coming into contact with and accordingly being damaged by the separation pawls. 36, owing to the provision of the sheet guide members 50 and the slant portions 60 on the inclined sheet-separation plate 8. Moreover, since the first angle α is made larger than the second angle β as described above, the provision of the slant portions 60 does not cause any adverse influence on the feeding of the sheet P, the separation of the sheets P from one another, etc.

In the present image recording apparatus 1 constructed as described above, each of the sheets P accommodated in the cassette body 3 is fed by the sheet-feed roller unit 6 toward the inclined sheet-separation plate 8 on which the separation pawls 36 are arranged. Even where two or more of the sheets P are fed at one time, the sheets P can be separated from one another by the cooperative action of the sheet-feed roller unit 6 and the separation pawls 36.

In the present embodiment, the sheet guide members 50 are provided on the inclined sheet-separation plate 8 disposed on the cassette body 3. Each sheet guide member 50 is configured to pivot about the corresponding shaft 53 and includes the first contact portion 51 and the second contact portion 52. Further, the sheet guide member 50 is provided with the leaf spring 54. The sheet guide member 50 is configured such that, owing to the biasing force of the leaf spring 54, the first contact portion 51 is located on the sheet feeding route while the second contact portion 52 does not protrude onto the front surface of the inclined sheet-separation plate 8. In the present embodiment, therefore, each sheet guide member 50 is kept in a state in which the first contact portion 51 thereof is surely located on the sheet feeding route by the biasing force of the leaf spring 54 acting on the sheet guide member 50.

When the feeding of each sheet P is started by the sheet-feed roller unit 6, the sheet P moves along the sheet feeding route and contacts the first contact portions 51 of the respective sheet guide members 50. The sheet P contacted the first contact portions 51 is further fed, so that the sheet guide members 50 pivot in the prescribed direction against the biasing force of the corresponding leaf springs 54. When each sheet guide member 50 pivots, the second contact portion 52 thereof protrudes onto the sheet feeding route through the corresponding opening 55 formed in the inclined sheet-separation plate 8. Since the second contact portion 52 protrudes from the front surface of the inclined sheet-separation plate 8 by the protrusion amount T, the sheet P being fed is moved away from the front surface by the distance that corresponds to the protrusion amount T. Further, because the protrusion amount T is larger than the protrusion amount H of the separation pawls 36, the sheet P contacted the second contact portions 52 is prevented from coming into contact with the tips of the separation pawls 36. In consequence, the sheet recording surface is prevented from being damaged due to otherwise possible contact with the separation pawls 36, so that the present image recording apparatus 1 ensures that the user's intended image can be recorded on each recording sheet P without suffering from any quality deterioration.

Each of the sheet guide members 50 in the present embodiment is structured such that the length of the first contact portion 51 is larger than that of the second contact portion 52. According to the structure, when the sheet P being fed comes into contact with the first contact portions 51 of the respective sheet guide members 50, there can be generated, in the sheet guide members 50, moment about the respective shafts 53 in a direction in which the second contact portions 52 protrude onto the sheet feeding route. That is, the sheet guide members 50 constructed as described above can reliably pivot about the corresponding shafts 53, whereby the damage on the sheet recording surface can be obviated.

Moreover, in the present embodiment, the sheet guide members 50 are disposed on the inclined sheet-separation plate 8 respectively near the opposite sides of the row of the separation pawls 36 such that, when the sheet guide members 50 pivot, the second contact portions 52 protrude from the front surface of the inclined sheet-separation plate 8 on the respective opposite sides of the row of the separation pawls 36. According to the structure, when the second contact portions 52 of the respective sheet guide members 50 protrude respectively on the opposite sides of the row of the separation pawls 36, the sheet P being fed is moved away from the tips of the separation pawls 36, thereby preventing, with high reliability, the sheet recording surface being damaged by the separation pawls 36.

Further, in the present embodiment, the slant portions 60 are provided on the upper end portion of the inclined sheet-separation plate 8. Each slant portion 60 is configured such that the slant portion 60 has the height U as measured from the front surface of the inclined sheet-separation plate 8 and such that the first angle α is larger than the second angle β. Because the height U of the slant portions 60 is larger than the protrusion amount H of the separation pawls 36, the sheet P being fed is apart from the front surface of the inclined sheet-separation plate 8 at the upper end portion of the same 8, by a distance larger than the protrusion amount H of the separation pawls 36. In consequence, the sheet P being fed is apart from the separation pawls 36 at upper and lower portions of the inclined sheet-separation plate 8 owing to the slant portions 60 and the second contact portions 52 of the sheet guide members 50. Thus, the damage of the sheet recording surface that arises from the contact with the separation pawls 36 can be obviated with high reliability. Further, each slant portion 60 is configured such that the first angle α is not smaller than the second angle β, whereby the damage of the sheet recording surface can be obviated while smoothly feeding the sheets P, without hindering the sheet separation function by the separation pawls 36.

In the present embodiment, the feeding direction of the sheet P that has passed on the inclined sheet-separation plate 8 is changed or shifted when the sheet P passes through the U-turned portion of the sheet-feed path 9 that is defined by the above-described first and second feed-path defining members. Upon change of the feeding direction, the sheet P being fed would come into strong contact with the separation pawls 36 if the sheet guide members 50 were not provided. In this instance, there is a high possibility of damaging the sheet recording surface. According to the present embodiment, however, the sheet guide members 50 pivot about the corresponding shafts 53 as explained above, so that the sheet P is moved in the direction away from the separation pawls 36 with high reliability. Accordingly, even in the sheet-feed device having the sheet-feed path 9 that includes the U-turned portion, the sheet recording surface can be prevented from coming into contact with and accordingly being damaged by the separation pawls 36.

According to the present embodiment, the sheet guide members 50 and the slant portions 60 permit each of the recording sheets P to be fed to the recording portion 7 with the recording surface thereof not being damaged, thereby obviating the quality deterioration of the image recorded thereon. In other words, the present image recording apparatus 1 ensures that the image can be recorded on each recording sheet P with the user's intended quality.

It is to be understood that the invention is not limited to the details of the illustrated embodiment, but may be embodied with various changes and modifications. For instance, while the image recording apparatus 1 in the illustrated embodiment is equipped with the single cassette body 3, the principle of the present invention is applicable to an image recording apparatus having vertically arranged two or more cassette bodies.

In the illustrated embodiment, owing to the biasing force of the leaf springs 54 provided on the respective sheet guide members 50, each sheet guide member 50 is kept in the state in which the first contact portion 51 is located on the sheet feeding route while the second contact portion 52 is retracted from the front surface of the inclined sheet-separation plate 8 so as not to protrude thereon. Such a state may be otherwise established by offering a good balance in weight between an upper portion (on the side of the first contact portion 51) and a lower portion (on the side of the second contact portion 52) of each sheet guide member 50, centered at the shaft 53, for instance.

As long as the protrusion amount T of the second contact portion 52 of each sheet guide member 50 when the sheet guide member 50 pivots and the height U of each slant portion 60 are made larger than the protrusion amount H of the separation pawls 36, it does not matter which one of the protrusion amount T and the height U is larger than the other. In this respect, it is possible to prevent the damage of the sheet recording surface with higher reliability by specifying that any one of the protrusion amount T and the height U is larger than the other.

What is claimed is:

1. A sheet-feed device, comprising:

a sheet accommodating portion in which recording sheets are accommodated so as to be stacked on each other;

a sheet-feed roller which feeds one of the recording sheets accommodated in the sheet accommodating portion, which one of the recording sheets is located uppermost among the recording sheets accommodated in the sheet accommodating portion;

an inclined sheet-separation plate which is disposed at a downstream portion of the sheet accommodating portion in a sheet-feed direction in which the one of the recording sheets is fed, so as to extend in a direction perpendicular to the sheet-feed direction and which is inclined, at a prescribed angle, with respect to the recording sheets accommodated in the sheet accommodating portion, the inclined sheet-separation plate having a height larger than a height of a maximum number of the recording sheets that can be accommodated in the sheet accommodating portion;

a plurality of separation pawls which are arranged on the inclined sheet-separation plate so as to be suitably spaced apart from each other in the sheet-feed direction and which cooperate with the sheet-feed roller to separate the one of the recording sheets from other recording sheets;

a sheet guide member which is supported on the inclined sheet-separation plate so as to pivot about a pivot axis that is perpendicular to the sheet-feed direction, the sheet guide member including:

a first contact portion which is located on a sheet feeding route on which the one of the recording sheets is fed and which is configured to contact the separated one of the recording sheets; and a second contact portion which is located on one of opposite sides of the pivot axis that is remote from the first contact portion and which is configured to protrude from the inclined sheet-separation plate so as to contact the separated one of the recording sheets owing to a pivotal movement of the sheet guide member by a contact of the separated one of the recording sheets with the first contact portion, whereby the separated one of the recording sheets is moved away from the plurality of separation pawls, wherein the first contact portion is configured to contact the separated one of the recording sheets on a downstream side of the plurality of separation pawls in the sheet feed direction and the second contact portion is configured to contact one of the recording sheets on an upstream side of the first contact portion in the sheet-feed direction for moving the separated one of the recording sheets away from the plurality of separation pawls.

2. The sheet-feed device according to claim 1, wherein the sheet guide member is configured such that a distance from the pivot axis to an end of the second contact portion is smaller than a distance from the pivot axis to an end of the first contact member.

3. The sheet-feed device according to claim 1, further comprising a biasing device that gives a biasing force to the sheet guide member, wherein the sheet guide member is configured to be biased by the biasing device when the first contact portion is not in contact with the separated one of the recording sheets, such that the first contact portion is located on the sheet feeding route and such that an amount of protrusion of the second contact portion from the inclined sheet-separation plate is smaller than an amount of protrusion of the plurality of separation pawls from the inclined sheet-separation plate.

4. The sheet-feed device according to claim 1, wherein the inclined sheet-separation plate is provided with two sheet guide members, each as the sheet guide member, which are disposed on opposite sides of the plurality of separation pawls in the direction perpendicular to the sheet-feed direction.

5. The sheet-feed device according to claim 1, wherein the inclined sheet-separation plate includes a slant portion which is disposed at a downstream portion thereof and which includes a slant surface that slants at a suitable slant angle with respect to the inclined sheet-separation plate, the slant portion having a height as measured from a surface of the inclined sheet-separation plate larger than an amount of protrusion of the plurality of separation pawls from the inclined sheet-separation plate, and wherein a first angle defined by (a) an imaginary plane on which are located a contact point of the sheet-feed roller and an uppermost one of the recording sheets accommodated in the sheet accommodating portion and an apex of the slant angle of the slant surface and (b) the slant surface is not smaller than a second angle defined by the surface of the inclined sheet-separation plate and a bottom surface of the sheet accommodating portion.

6. The sheet-feed device according to claim 1, further comprising a sheet-feed-direction changing portion which is disposed on a downstream side of the inclined sheet-separation plate in the sheet-feed direction and which is configured to change a direction of feeding of the separated one of the recording sheets fed from the sheet accommodating portion by the sheet-feed roller.

7. An image recording apparatus, comprising:

the sheet-feed device according to claim 1;

an image recording unit which records an image on the one of the recording sheets fed by the sheet-feed device; and a sheet discharger which discharges the one of the recording sheets on which the image has been recorded by the image recording unit.

* * * * *